US006520750B2

(12) United States Patent
Eller et al.

(10) Patent No.: US 6,520,750 B2
(45) Date of Patent: Feb. 18, 2003

(54) PUMPING APPARATUS WITH EXTENDABLE DRAWING PIPE AND IMPELLER AND IMPELLER HYDRAULIC DRIVE MEANS SUPPLIED BY A HYDRAULIC HOSE CARRIED BY A SEGMENTED HYDRAULIC HOSE SUPPORT

(76) Inventors: James David Eller, 201 N. Federal Hwy., Deerfield Beach, FL (US) 33441; Dana J. Eller, 201 N. Federal Hwy., Deerfield Beach, FL (US) 33441; Darren J. Eller, 201 N. Federal Hwy., Deerfield Beach, FL (US) 33441

( * ) Notice: Subject to any disclaimer, the term of this patent is extended or adjusted under 35 U.S.C. 154(b) by 0 days.

(21) Appl. No.: 09/971,398

(22) Filed: Oct. 5, 2001

(65) Prior Publication Data

US 2002/0051713 A1 May 2, 2002

Related U.S. Application Data

(63) Continuation-in-part of application No. 09/444,626, filed on Nov. 22, 1999, now Pat. No. 6,447,260.

(51) Int. Cl.[7] ..... F04B 53/00; F04B 17/00
(52) U.S. Cl. ..... 417/234; 417/361
(58) Field of Search ..... 417/234, 231, 417/316; 138/106

(56) References Cited

U.S. PATENT DOCUMENTS 2,896,543 A * 7/1959 Ogles ..... 415/143
3,270,677 A * 9/1966 Eller et al. ..... 415/195
3,884,528 A * 5/1975 Shaddock ..... 302/58
3,910,722 A * 10/1975 Hochmuth ..... 417/34
4,070,135 A * 1/1978 Eller ..... 417/234
4,616,979 A * 10/1986 Hynes et al. ..... 417/234
5,624,241 A * 4/1997 Nesseth ..... 417/234

* cited by examiner

*Primary Examiner*—Charles G. Freay
*Assistant Examiner*—Michael K. Gray
(74) *Attorney, Agent, or Firm*—Oltman, Flynn & Kubler

(57) ABSTRACT

A pumping apparatus for delivering water upwardly from a holding area and over a holding area bank includes an apparatus base; a water drawing pipe having a pipe intake end and a pipe discharge end and being mounted to the apparatus base and extendable from the apparatus base; an impeller rotatably mounted within the drawing pipe discharge end; a hydraulic motor drivably connected to the impeller at the drawing pipe discharge end; a hydraulic pump having a pump intake side and a pump output side; a flexible hydraulic supply hose connected to the pump output side and extending along the drawing pipe to the hydraulic motor; a flexible hydraulic return hose extending from the hydraulic motor along the drawing pipe to the pump intake side; a segmented hose track having a longitudinal track passageway through which the supply and return hoses extend and having a minimum bend radius great enough to prevent the supply and return hoses from kinking.

7 Claims, 9 Drawing Sheets

10
12
18
20
22
24
30
70
72
74
76
78
82
112
114
122
130
152
W
G

PUMPING APPARATUS WITH EXTENDABLE DRAWING PIPE AND IMPELLER AND IMPELLER HYDRAULIC DRIVE MEANS SUPPLIED BY A HYDRAULIC HOSE CARRIED BY A SEGMENTED HYDRAULIC HOSE SUPPORT

This application is a continuation-in-part of application Ser. No. 09/444,626 filed on Nov. 22, 1999, which issued as U.S. Pat. No. 6,447,260 on Sep. 10, 2002.

BACKGROUND OF THE INVENTION

1. Field of the Invention

The present invention relates generally to the field of pumping mechanisms. More specifically the present invention relates to a pumping apparatus for drawing water from a low lying holding area and delivering the water upwardly and over the bank of the holding area to any designated receiving area or means. The apparatus includes an apparatus base such as a trailer bed and including a water drawing pipe having a pipe intake end and having a pipe discharge end containing an impeller drivably connected to a hydraulic motor which receives pressurized hydraulic fluid through a flexible hydraulic supply hose extending along the drawing pipe from the output side of a hydraulic pump and the hydraulic motor releasing hydraulic fluid into a flexible return hose extending along the drawing pipe to the intake side of the hydraulic pump, a deployment and angling cable means which moves the drawing pipe between a retracted position on the apparatus base and a deployed position extending outwardly and angling downwardly from the apparatus base into the water in the given holding area, and a segmented hose track which forms a continuous bend radius great enough to prevent the hose from kinking or collapsing when the drawing pipe and hose are retracted and which permits the hose to unroll and extend with the drawing pipe as the drawing pipe is deployed, and once again, to coil back into its pre-set bend radius as the drawing pipe is retracted.

2. Description of the Prior Art

There have been water pump assemblies for gathering water from holding areas and delivering the water at a high flow rate to a receiving area. The most notable such pump assembly is U.S. Pat. No. 3,270,677 issued on Sep. 6, 1966 to the present applicant, which functions very effectively, but is limited as to the depth of water it can reach in a holding area.

It is thus an object of the present invention to provide a water pumping apparatus which can reach and gather water in a deep holding area through an extendable water drawing pipe having a distally located, intake end containing an impeller powered by a hydraulic motor.

It is another object of the present invention to provide such an apparatus in which the hydraulic motor is supplied with pressurized hydraulic fluid through a flexible hydraulic supply hose extending from a point proximal to the intake end and is drained of hydraulic fluid through a flexible hydraulic supply hose extending back along the drawing pipe, the hydraulic supply and return hoses being mounted within a segmented hose track which limits the bend radius of the hoses sufficiently to prevent hose kinking and collapse.

It is still another object of the present invention to provide such an apparatus in which the water drawing pipe telescopingly retracts to become shorter to fit compactly onto an apparatus base.

It is finally an object of the present invention to provide such an apparatus which is relatively inexpensive to manufacture, maintain and transport, and which is highly reliable.

SUMMARY OF THE INVENTION

The present invention accomplishes the above-stated objectives, as well as others, as may be determined by a fair reading and interpretation of the entire specification.

A pumping apparatus is provided for delivering water upwardly from a holding area and over a holding area bank, the apparatus including an apparatus base; a water drawing pipe having a pipe intake end and a pipe discharge end and being mounted to the apparatus base and extendable from the apparatus base; an impeller rotatably mounted within the drawing pipe discharge end; a hydraulic motor drivably connected to the impeller at the drawing pipe intake end; a hydraulic pump having a pump intake side and a pump output side; a flexible hydraulic supply hose connected to the pump output side and extending along the drawing pipe to the hydraulic motor; a flexible hydraulic return hose extending from the hydraulic motor along the drawing pipe to the pump intake side; a segmented hose track having a longitudinal track passageway through which the supply and return hoses extend and having a minimum bend radius great enough to prevent the supply and return hoses from kinking and permitting the hoses to unroll and extend with the drawing pipe as the drawing pipe is deployed and to coil back into the minimum bend radius as the drawing pipe is retracted without kinking or collapse; and a drawing pipe extending mechanism for moving the drawing pipe between a retracted position on the apparatus base and a deployed position extending outwardly and angling downwardly from the apparatus base into water in a given holding area.

The apparatus base preferably includes a flat bed trailer. The segmented hose track preferably includes a series of track segments, each track segment being pivotally interconnected to an immediately adjacent the track segment in the series. Each track segment preferably includes a pair of laterally spaced apart, substantially parallel plates having pivot pins at plate forward and rearward ends connecting the given the track segment to plates forming one of a previous and a subsequent track segment; and having hose retaining interconnection struts extending between the plates, defining the interior passageway through which the supply and return hoses extend.

The drawing pipe preferably includes a wider outer pipe segment having an outer pipe receiving end; and an inner pipe segment having an inner pipe contained end located inside the outer pipe segment, the inner pipe segment being telescopingly mounted within the outer pipe segment; where the drawing pipe extending mechanism moves the inner pipe segment into and out of the outer pipe segment so that at least a portion of the inner pipe is slidably retained within the outer pipe segment. The drawing pipe extending mechanism preferably includes a winch secured relative to the apparatus base; and a cable connection structure secured to the drawing tube intake end. The apparatus may additionally include a collapsible water discharge hose sealingly secured to the water drawing pipe discharge end and extending over the apparatus base.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
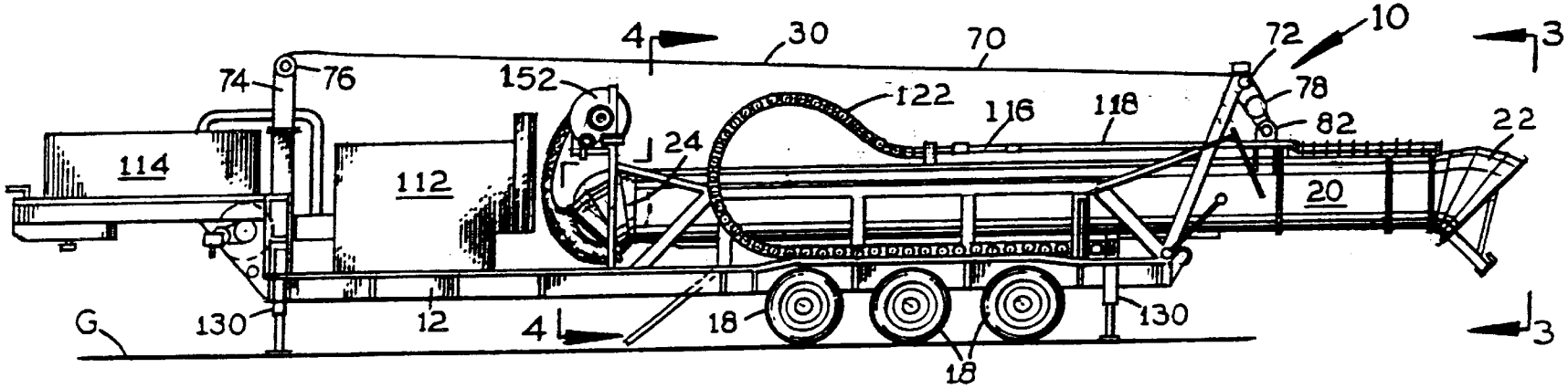
FIG. 1 is a side view of the pumping apparatus showing the water drawing pipe retracted onto the apparatus base, which in this instance is a tractor trailer bed.
Figure 2:
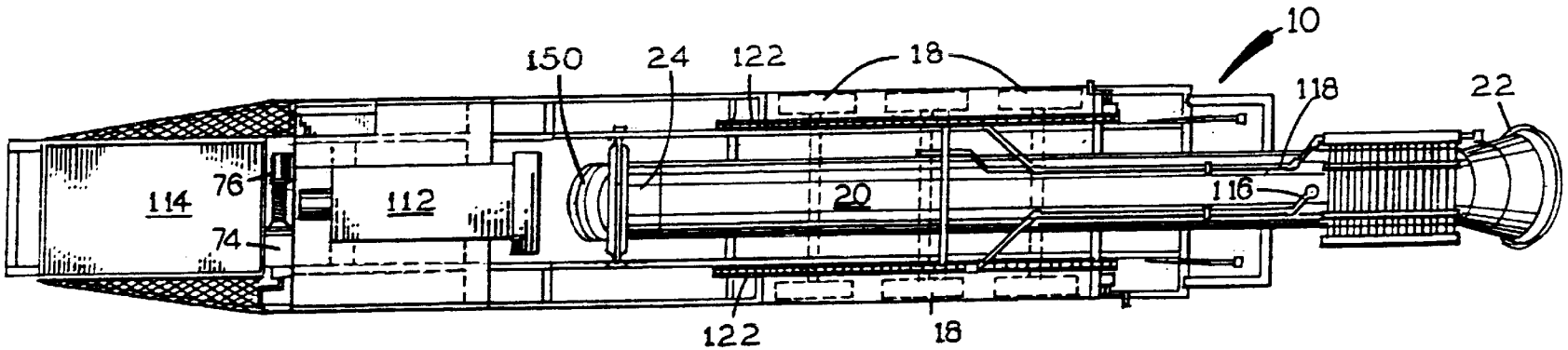
FIG. 2 is a top view of the pumping apparatus of FIG. 1.
Figures 3, 4, 8:
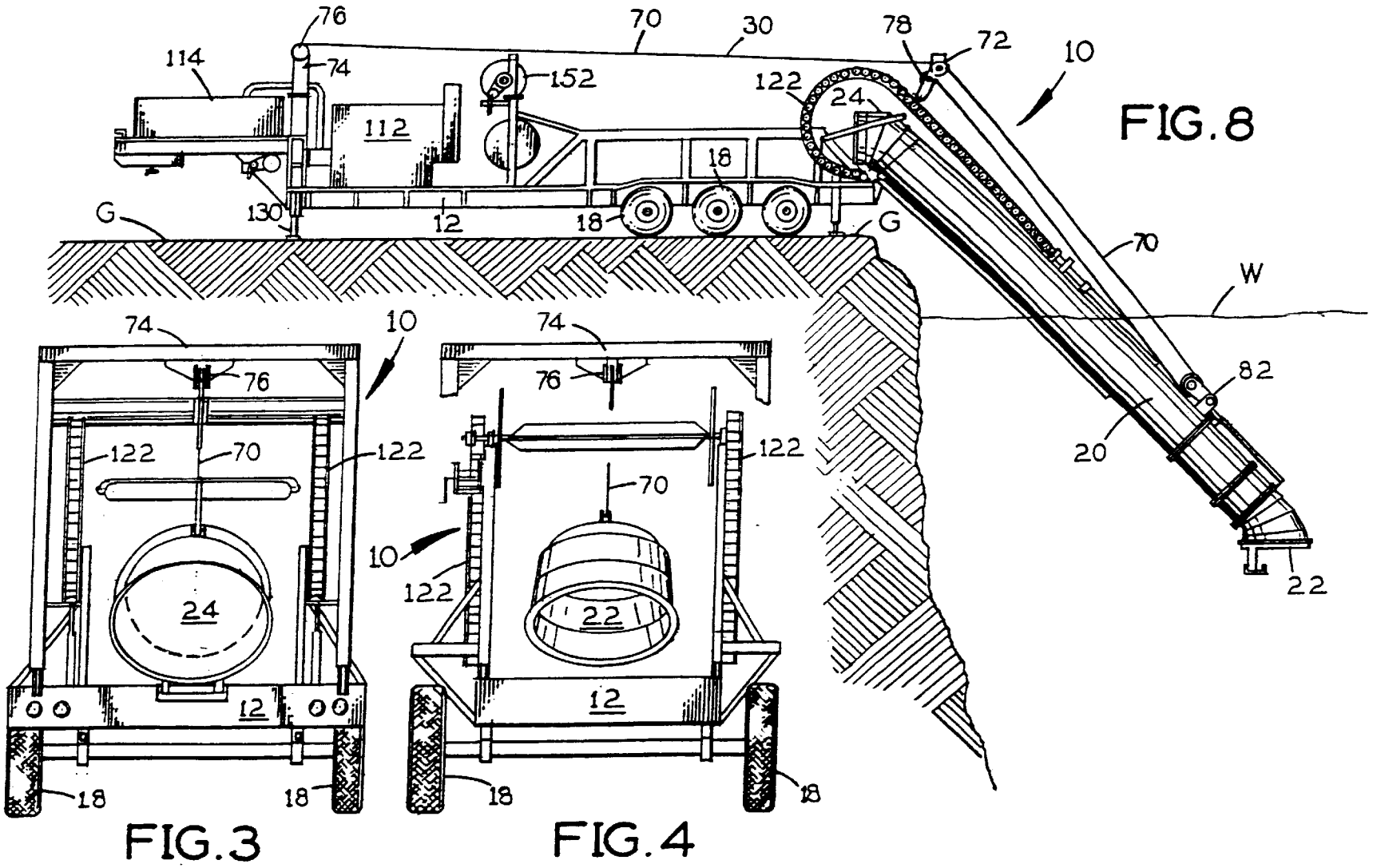
FIG. 3 is an end view of the pumping apparatus from the holding area end.
FIG. 4 is an end view of the pumping apparatus from the water discharge end.
FIG. 8 is a side view of the pumping apparatus resting on a bank of a holding area, with the drawing pipe extended and angled downwardly into the water in the holding area.
Figure 5:
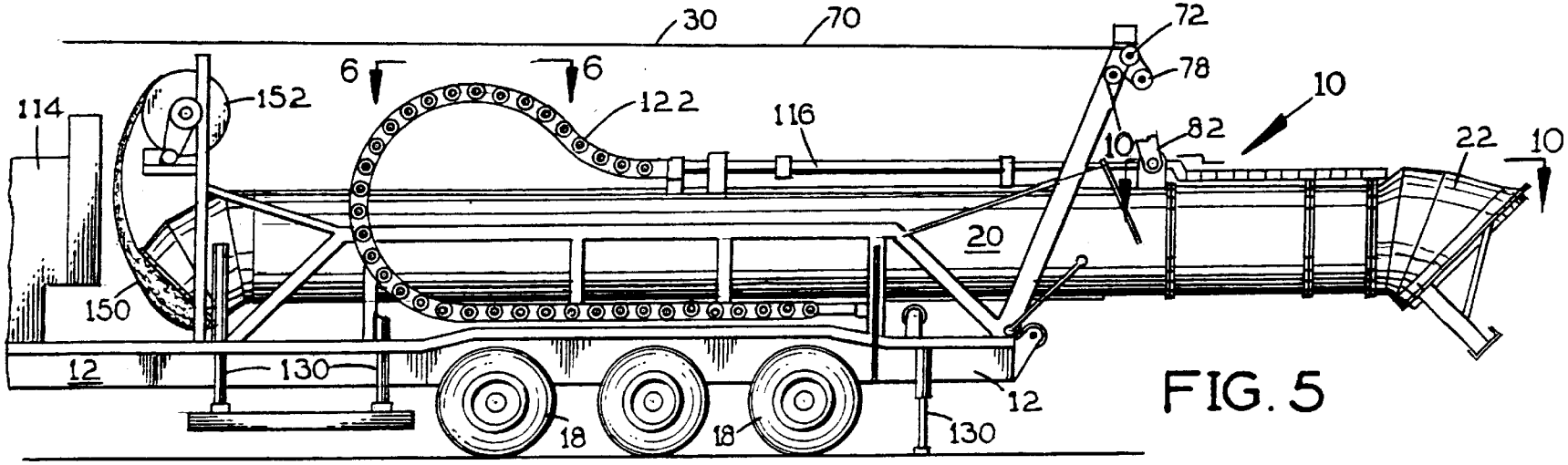
FIG. 5 is a close-up partial side view of the apparatus of FIG. 1 showing more clearly the segmented hose track.
Figure 7:
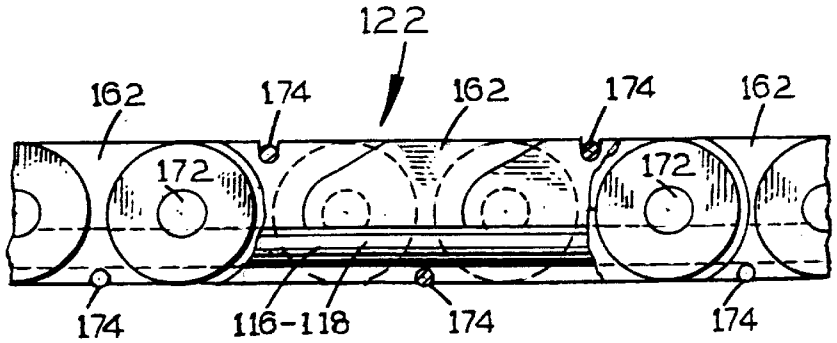
FIG. 7 is a side view of the portion of the segmented hose track shown in FIG. 6, revealing a portion of one of the hydraulic hoses within the track passageway.
Figure 6:
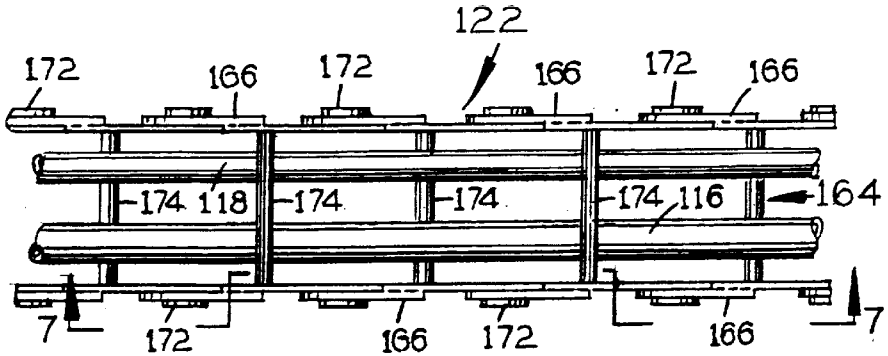
FIG. 6 is a top view of a portion of the segmented hose track, showing portions of the supply and return hoses within the track passageway.
Figure 9:
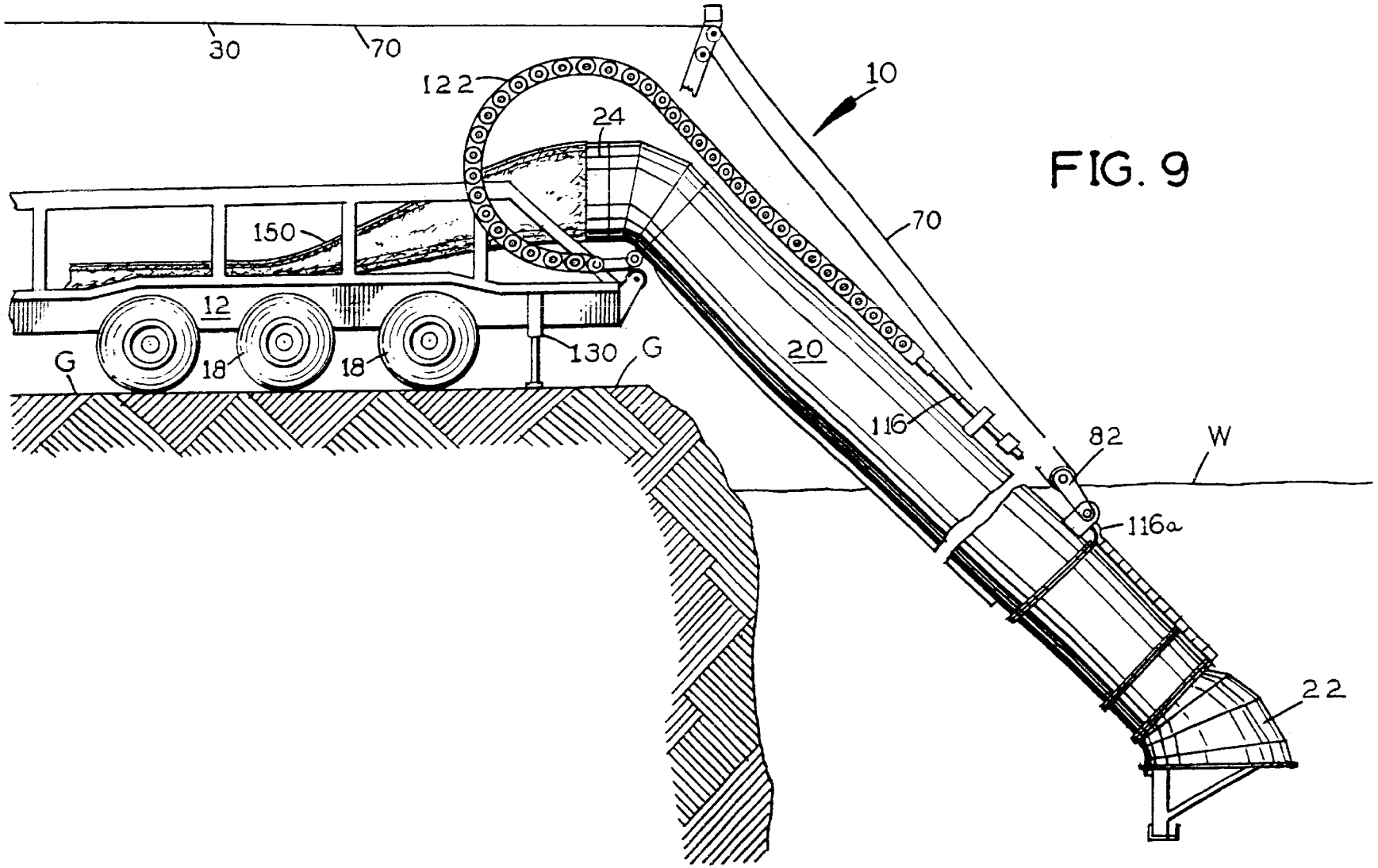
FIG. 9 is a close-up, partial side view of the pumping apparatus of FIG. 8, showing the shape of the segmented hose track when the drawing pipe is extended.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1–16, a pumping apparatus 10 is disclosed, for drawing water W from a low lying holding area and delivering the water upwardly to and beyond a bank on which apparatus 10 rests to any designated receiving area or means. The contents of U.S. Pat. No. 3,270,677 issued on Sep. 6, 1966 to the present applicant is incorporated by reference into the present application.

Apparatus 10 includes an apparatus base 12 such as a trailer bed and includes a water drawing pipe 20 having a pipe intake end 22 and having a pipe discharge end 24 containing an impeller 102 drivably connected to a hydraulic motor 110 with an impeller drive shaft 104 riding on drive shaft bearings 108, the hydraulic motor 110 receiving pressurized hydraulic fluid through a flexible hydraulic supply hose 116 extending along the drawing pipe 20 from the output side of a hydraulic pump 112 and the hydraulic motor 110 releasing hydraulic fluid into a flexible return hose 118 extending along the drawing pipe 20 to the intake side of the hydraulic pump 112, a deployment and angling drawing pipe extending means 30 which moves the drawing pipe 20 between a retracted position on the apparatus base 12 and a deployed position extending outwardly and angling downwardly from the apparatus base 12 into the water in the given holding area, and a segmented hose track 122 which forms a continuous bend radius great enough to prevent supply and return hoses 116 and 118 from kinking or collapsing when the drawing pipe 20 and hoses 116 and 118 are retracted and which permits hoses 116 and 118 to unroll and extend with the drawing pipe 20 as the drawing pipe 20 is deployed, and once again, to coil back into its pre-set bend radius as the drawing pipe 20 is retracted.

The segmented hose tract 122 is of a pre-existing design used on assemblies other than pumps. Hose track 122 is made up of a series of track segments 162, each track segment 162 being pivotally interconnected with the next track segment 162 in the series, and the series of track segments 162 together defining an open interior passageway 164 through which supply and return hoses 116 and 118, respectively, extend along the length of the track 122. Each track segment 162 preferably includes a pair of laterally spaced apart, parallel track plates 166 having pivot pins 172 at track plate 166 forward and rearward ends connecting the given segment 162 to track plates 166 forming any immediately previous or immediately subsequent track segments 162, and having hose retaining interconnection struts 174 extending between the track plates 166 near the track plate 166 lateral peripheries. The preferred type of hose track is the NYLATRAC™, P7N Series cable and hose carriers produced by GORTRAC™, Division of A&A Manufacturing Company, Inc.

Hydraulic supply and return hoses 116 and 118 extend from hydraulic pump 112, through the interior passageway 164 of segmented hose track 122, through stirrups attached along the exterior of the drawing pipe 20, through a lateral port 124 in drawing pipe intake end 22 to hydraulic motor 110 for powering the rotation of impeller 102.

Figure 10:
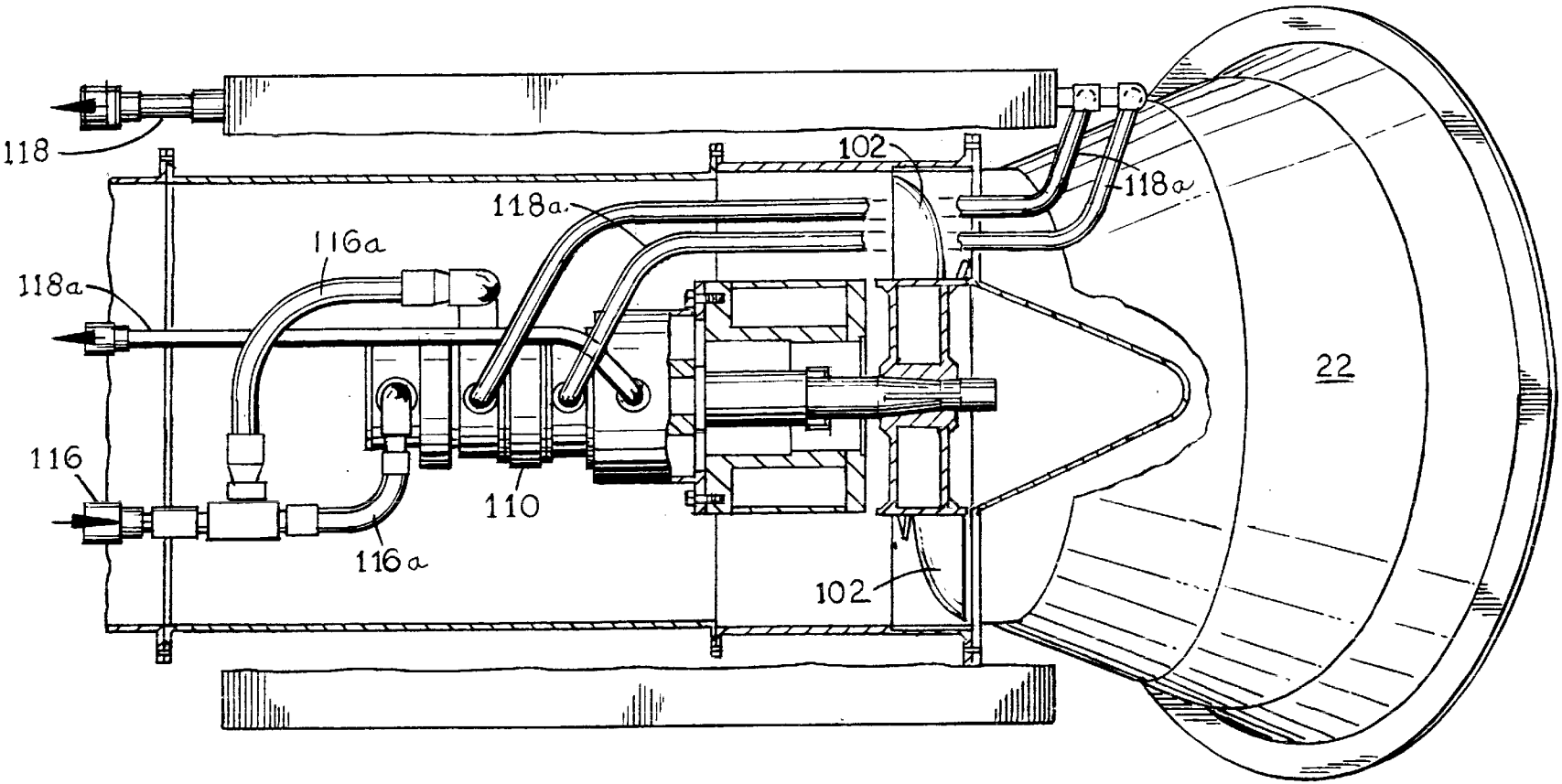
FIG. 10 is a top view of the pump showing supply and return lines.
Figure 11:
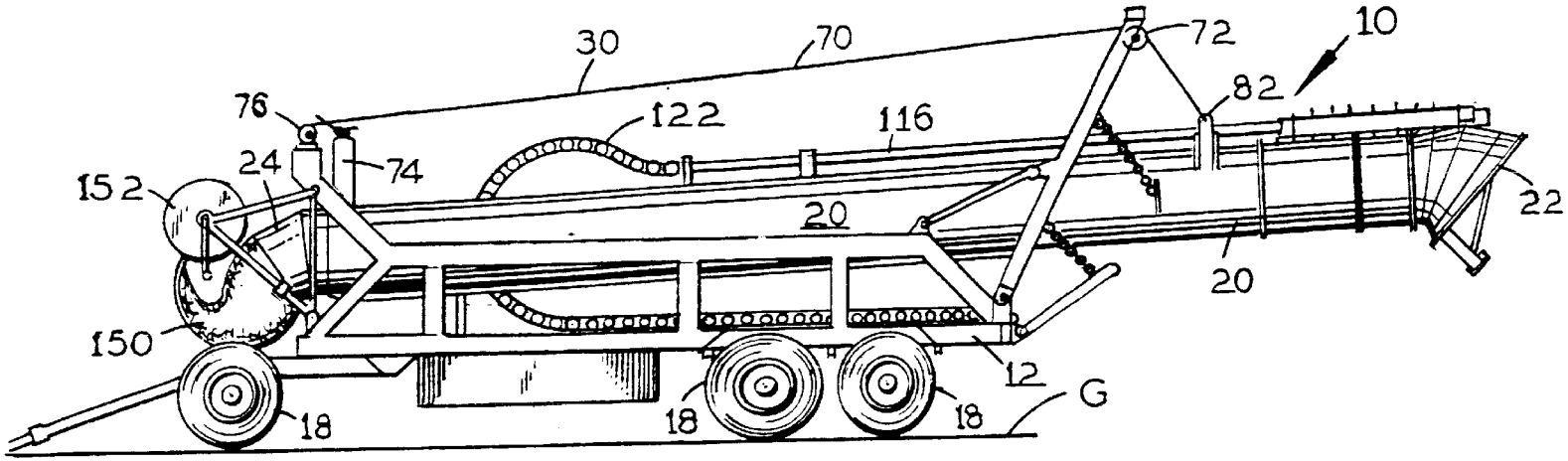
FIG. 11 is a side view of a smaller version of the pumping apparatus, omitting the diesel engine and hydraulic fluid tank, with the drawing pipe retracted onto the apparatus base.
Figure 12:
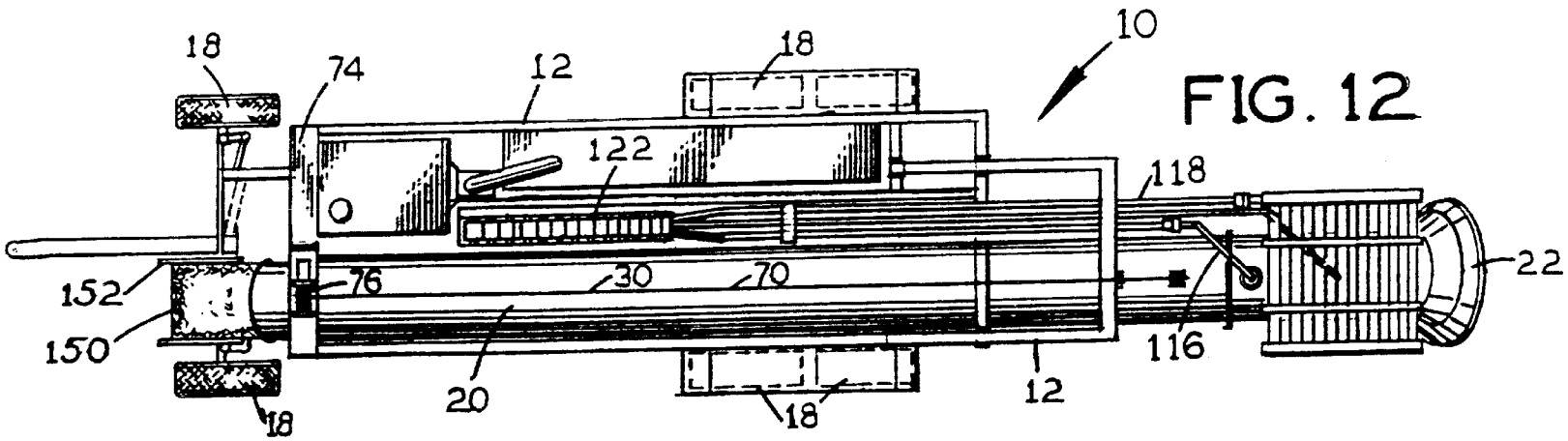
FIG. 12 is a top view of the pumping apparatus of FIG. 11.
Figures 13, 14:
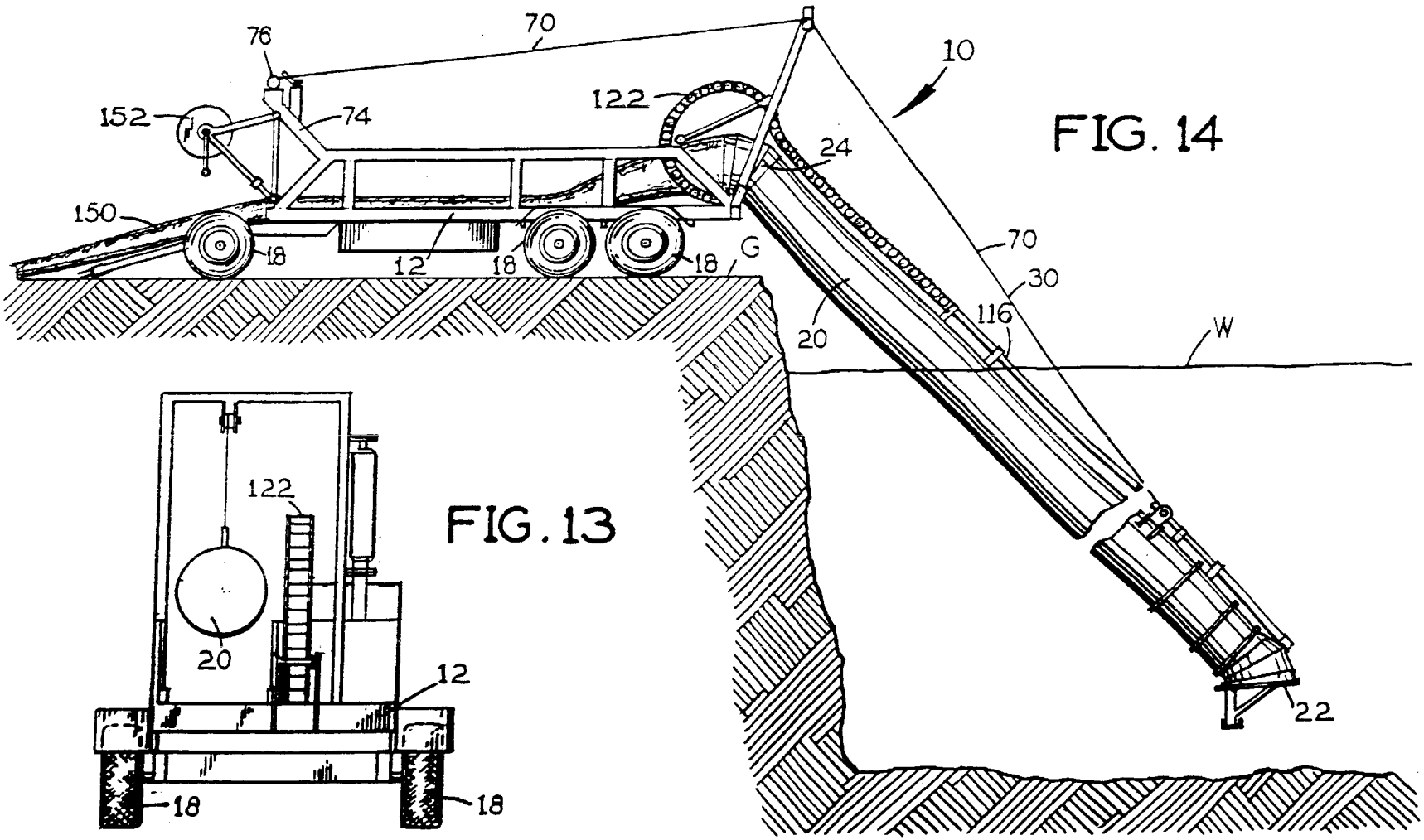
FIG. 13 is an end view of the pumping apparatus of FIG. 11.
FIG. 14 is a side view of the pumping apparatus of FIG. 11 resting on a bank of the holding area with the drawing pipe extended into the water in the holding area.
Figure 15:
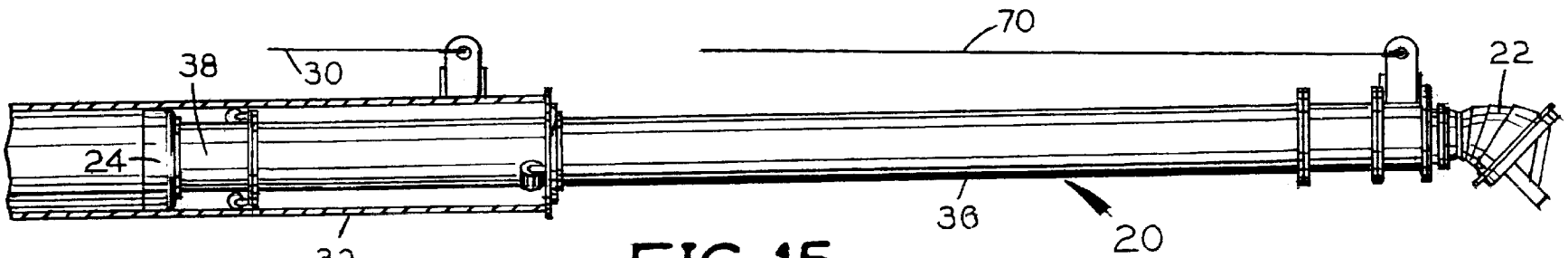
FIG. 15 is a side view of the telescoping version of the drawing pipe, showing the outer pipe in cross-section to reveal the inner pipe contained end.
Figure 16:
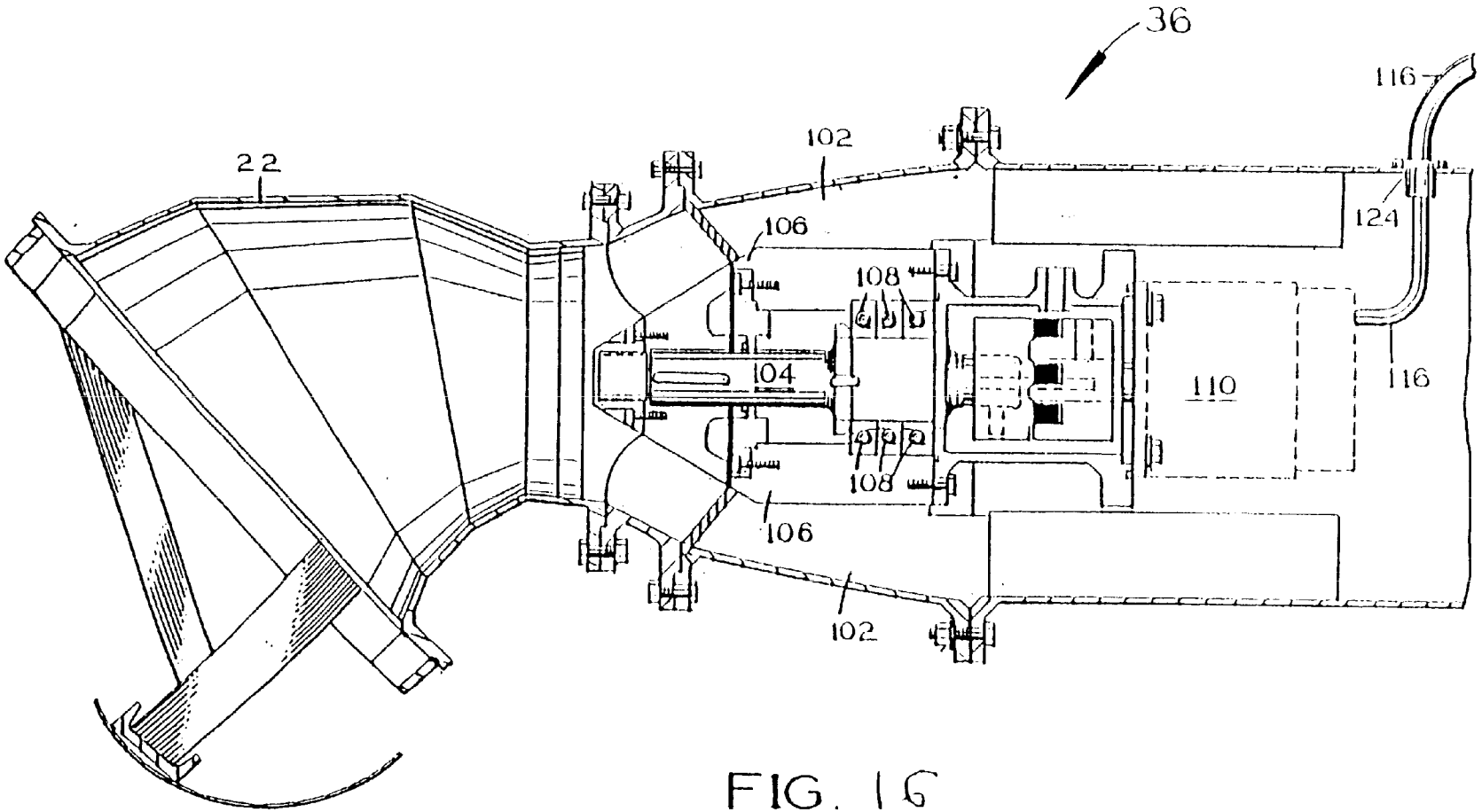
FIG. 16 is a cross-sectional side view of the drawing pipe intake end revealing the impeller drive shaft and hydraulic motor.

In the pump of FIG. 10, there is a supply pipe or hose 116 and a return pipe or hose 118. Internal pipes or hoses **116*a* and conduct hydraulic fluid from supply hose 116 to inlet pumps 112 and back out the return hoses 118 and 118*a*. Hose 118*a* joins with hose 118** (not shown).

Drawing pipe 20 preferably includes a wider outer pipe segment 32 having an outer pipe receiving end 34 and a telescoping narrower inner pipe segment 36 having an inner pipe contained end 38. Inner pipe segment 36 telescopes out of outer pipe segment 32 while drawing pipe 20 tilts downwardly to access water in deeper holding areas, and inner pipe segment 36 telescopes into outer pipe segment 32 while composite drawing pipe 20 tilts upwardly toward horizontal to retract combined drawing pipe 20 into a shorter transport and storage configuration. Drawing pipe extending means 30 moves inner pipe segment 36 into and out of outer pipe segment 32.

Drawing pipe extending means 30 preferably includes a winch 76 secured to a mounting structure 74 on the apparatus base 12, a first cable pulley 72, a second cable pulley 78, a cable connection structure 82 on or near the drawing tube intake end 22, and a cable 70 would around the winch and extending over first and second cable pulleys 72 and 78, respectively.

Apparatus 10 preferably further includes a hydraulic fluid tank 114 serving as a holding area for hydraulic fluid returning from the hydraulic motor 110 prior to being drawn into hydraulic pump 112, a diesel engine drivably connected to the hydraulic pump 112 (shown together as a single element with single reference numeral 112), a collapsible water hose 150 secured to the discharge end 24 of the drawing pipe 20, and a water hose spool 152 for receiving and compactly winding the water hose 150. The apparatus base 12 preferably is a truck bed, as indicated above, and has truck bed wheels with tires 18 and hydraulic jacks 130 for bearing against the ground G and lifting the truck bed off tires 18 to immobilize apparatus 10 while water is being pumped.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A pumping apparatus for delivering water upwardly from a holding area and over a holding area bank, comprising:

an apparatus base;

a water drawing pipe comprising a pipe intake end and a pipe discharge end and being mounted to said apparatus base and extendable from said apparatus base;

an impeller rotatably mounted within said drawing pipe intake end;

a hydraulic motor drivably connected to said impeller at said drawing pipe intake end;

a hydraulic pump having a pump intake side and a pump output side;

a flexible hydraulic supply hose connected to said pump output side and extending along said drawing pipe to said hydraulic motor;

a flexible hydraulic return hose extending from said hydraulic motor along said drawing pipe to said pump intake side;

a segmented hose track having a longitudinal track passageway through which said supply and return hoses extend and having a minimum bend radius great enough to prevent said supply and return hoses from kinking and permitting said hoses to unroll and extend with said drawing pipe as said drawing pipe is deployed and to coil back into the minimum bend radius as said drawing pipe is retracted without kinking or collapse;

and a drawing pipe extending means for moving said drawing pipe between a retracted position on said apparatus base and a deployed position extending outwardly and angling downwardly from said apparatus base into water in a given holding area.

2. The pumping apparatus of claim 1, wherein said apparatus base comprises a flat bed trailer.

3. The pumping apparatus of claim 1, wherein said segmented hose track comprises a series of track segments, each said track segment being pivotally interconnected to an immediately adjacent said track segment in the series.

4. The pumping apparatus of claim 1, wherein each said track segment comprises:

a pair of laterally spaced apart, substantially parallel track plates having pivot pins at track plate forward and rearward ends connecting the given said track segment to track plates forming one of a previous and a subsequent track segment;

and having hose retaining interconnection struts extending between said track plates, defining said interior passageway through which said supply and return hoses extend.

5. The pumping apparatus of claim 1, wherein said drawing pipe comprises:

a wider outer pipe segment having an outer pipe receiving end;

and an inner pipe segment having an inner pipe contained end located inside said outer pipe segment, said inner pipe segment being telescopingly mounted within said outer pipe segment;

wherein said drawing pipe extending means moves said inner pipe segment into and out of said outer pipe segment such that at least a portion of said inner pipe is slidably retained within said outer pipe segment.

6. The pumping apparatus of claim 1, wherein said drawing pipe extending means comprises:

a winch secured relative to said apparatus base;

and a cable connection structure secured to said drawing tube intake end.

7. The apparatus of claim 1, additionally comprising a collapsible water discharge hose sealingly secured to said water drawing pipe discharge end and extending over said apparatus base.

* * * * *